US005517885A

United States Patent [19]

Feng

[11] Patent Number: 5,517,885

[45] Date of Patent: May 21, 1996

[54] SCREWDRIVER WITH SLIDABLY STORED TOOL HEAD MODULE

[76] Inventor: Yee-Chang Feng, P.O. Box 30-108, Taichung, Taiwan

[21] Appl. No.: 355,473

[22] Filed: Dec. 14, 1994

Related U.S. Application Data

[63] Continuation-in-part of Ser. No. 260,329, Jun. 15, 1994.

[51] Int. Cl.[6] ..... B25B 23/16; B25G 1/08

[52] U.S. Cl. ..... 81/177.4; 81/490; 81/439

[58] Field of Search ..... 81/177.1, 177.4, 81/489, 490, 439, 438, 437; 206/378, 379; 220/315, 318, 345, 346

[56] References Cited

U.S. PATENT DOCUMENTS

| | | | |
|---|---|---|---|
| 2,749,953 | 6/1956 | Rundle | 81/490 |
| 3,750,729 | 8/1973 | Lemieux | 81/439 |
| 4,227,430 | 10/1980 | Jansson et al. | 81/177.4 |
| 4,794,692 | 1/1989 | Wang | 30/123 |
| 5,265,504 | 11/1993 | Fruhm | 81/177.4 |

FOREIGN PATENT DOCUMENTS

| | | | |
|---|---|---|---|
| 3004958 | 8/1981 | Germany | 81/439 |

*Primary Examiner*—Bruce M. Kisliuk
*Assistant Examiner*—Joni Danganan
*Attorney, Agent, or Firm*—Bacon & Thomas

[57] ABSTRACT

A screwdriver with slidably stored tool head module, comprising a casing and at least one cartridge slidably received in the casing and formed with multiple chambers for containing a module of multiple tool heads. The casing has a front end for engaging with a support rod in which a tool head is exchangeably fitted, and a rear receptacle for receiving the cartridge. A pushing lever is lengthwise disposed on a lateral side of the cartridge and the casing is formed with a lengthwise guiding channel on a lateral side for receiving and lengthwise slidably guiding the pushing lever. The cartridge is easily lengthwise movable outward from the casing for selectively taking out a tool head of the module from the cartridge or placing a used tool head into the cartridge.

7 Claims, 6 Drawing Sheets

SCREWDRIVER WITH SLIDABLY STORED TOOL HEAD MODULE

CROSS-REFERENCE TO RELATED APPLICATION

This application is a continuation-in-part of application U.S. patent application Ser. No. 08/260,329, filed on Jun. 15, 1994.

BACKGROUND OF THE INVENTION

1. Field of the Invention

The present invention relates to a screwdriver with a slidably stored tool head module, and more particularly to a screwdriver which enables a user, during working to easily push a stored tool head module outward with only one finger and select a suitable tool head therefrom for different types or sizes of screws or replace the tool head module.

2. Brief Description of Prior Art

A conventional screwdriver with stored interchangeable tool heads is widely used in different working sites for unscrewing various kinds of screws with different sizes. However, when selecting a reserved tool head, such a conventional screwdriver has several shortcomings as follows:

1. The reserved tool heads are stored in the handle of the screwdriver. The handle has limited interior room so that the type, size and amount of the stored tool heads are accordingly limited. As a result, such screwdriver can only provide limited tool head-exchanging function.
2. In the applicant's patent application Ser. No. 08/260,329, a screwdriver with a module of exchangeable tool heads is disclosed, wherein when exchanging the tool heads, a user must first stop working and use both hands to detach the module associated with the support of the screwdriver and then select a suitable tool head. Such procedure is quite troublesome to the user, especially in a working state.

Therefore, it is necessary to develop an improved screwdriver to eliminate the above shortcomings.

SUMMARY OF THE INVENTION

It is therefore a primary object of the present invention to provide a screwdriver with a slidably stored tool head module, in which the tool head module is replaceable so that the the tool head-storing room is enlarged without the limitation of the interior space of the handle of the screwdriver and more reserved tool heads are exchangeable with a used one.

It is a further object of the present invention to provide the above screwdriver which enables a user, during working, to easily push a stored tool head module outward with only one finger and select a suitable tool head therefrom.

According to the above objects, the screwdriver of the present invention includes a casing and a cartridge slidably received in the casing for containing a module of multiple tool heads. The casing has a front end for engaging with a support rod in which a tool head is exchangeably fitted, and a rear receptacle for receiving the cartridge. The cartridge is formed with multiple chambers for receiving various reserved tool heads and a support rod seat for receiving a detached support rod. A pushing lever is lengthwise disposed on a lateral side of the cartridge and the casing is formed with a lengthwise guiding channel on a lateral side for receiving and slidably guiding the pushing lever, whereby the cartridge is easily movable outward from the casing or inward toward the casing with one finger for selectively taking out a tool head of the module from the cartridge or placing a used tool head into the cartridge.

The present invention can be best understood through the following description and accompanying drawing, wherein:

DETAILED DESCRIPTION OF THE PREFERRED EMBODIMENTS

Figure 1:
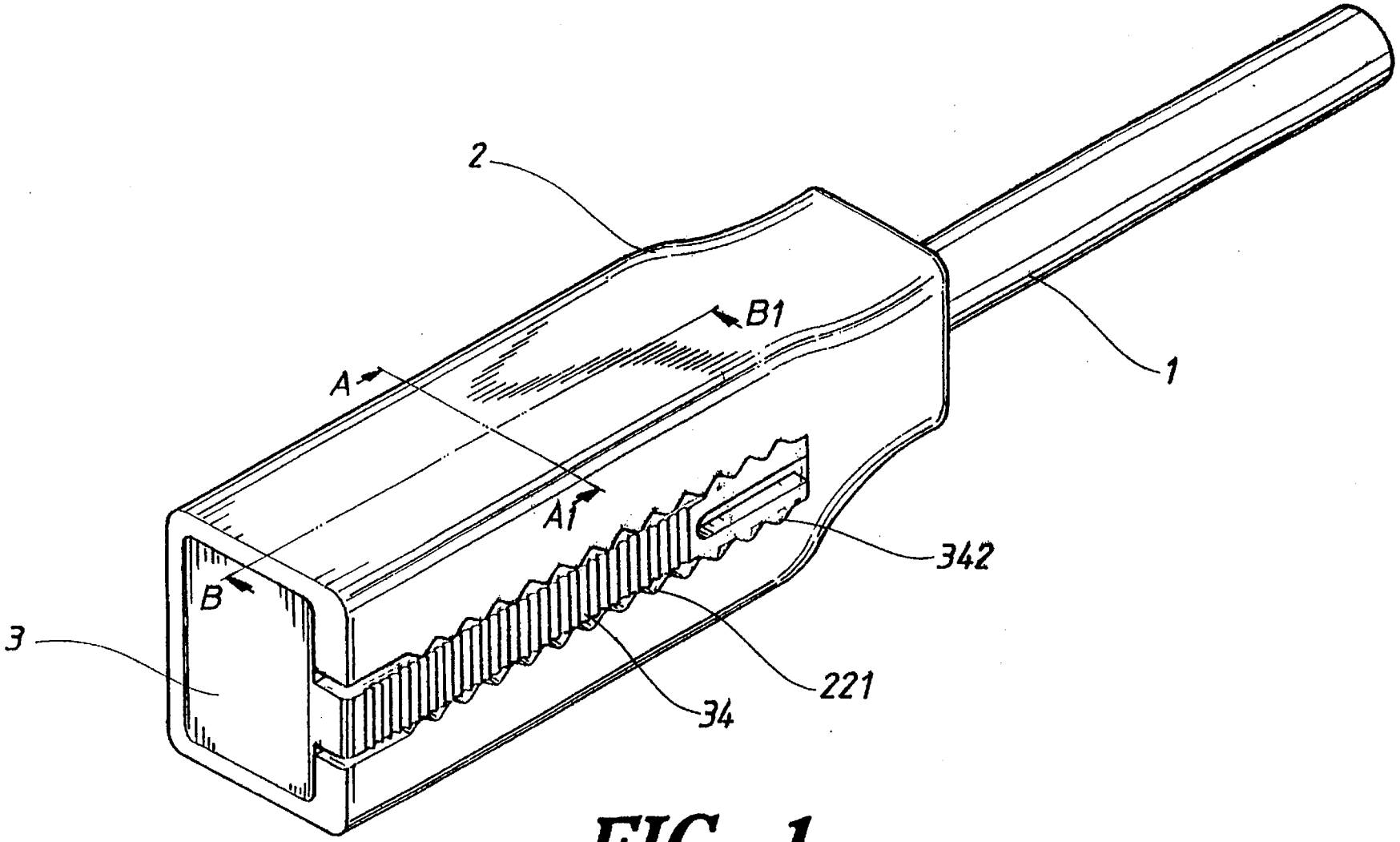
FIG. 1 is a perspective assembled view of a first embodiment of the present invention.

Please refer to FIG. 1 which shows a first embodiment of the present invention, wherein the screwdriver is mainly composed of a casing 2 and a cartridge 3 slidably received in the casing 2. At a front end of the casing 2 is disposed an elongated support rod 1. A tool head is exchangeably fitted in a front end of the support rod 1. A pushing lever 34 is lengthwise disposed on a lateral side of the cartridge 3. A front end of the pushing lever 34 is formed with a dented section 342 and the casing 2 is formed with a lengthwise guiding channel 22 on a lateral side. The guiding channel 22 has a dented upper edge and dented lower edge 221 corresponding to and engaging with the dented section 342 of the pushing lever 34. The cartridge 3 is adapted to be slidably received in a rear receptacle 21 of the casing 2. The surface of the pushing lever 34 is waved for facilitating the outward or inward pushing of the cartridge 3.

Figure 2:
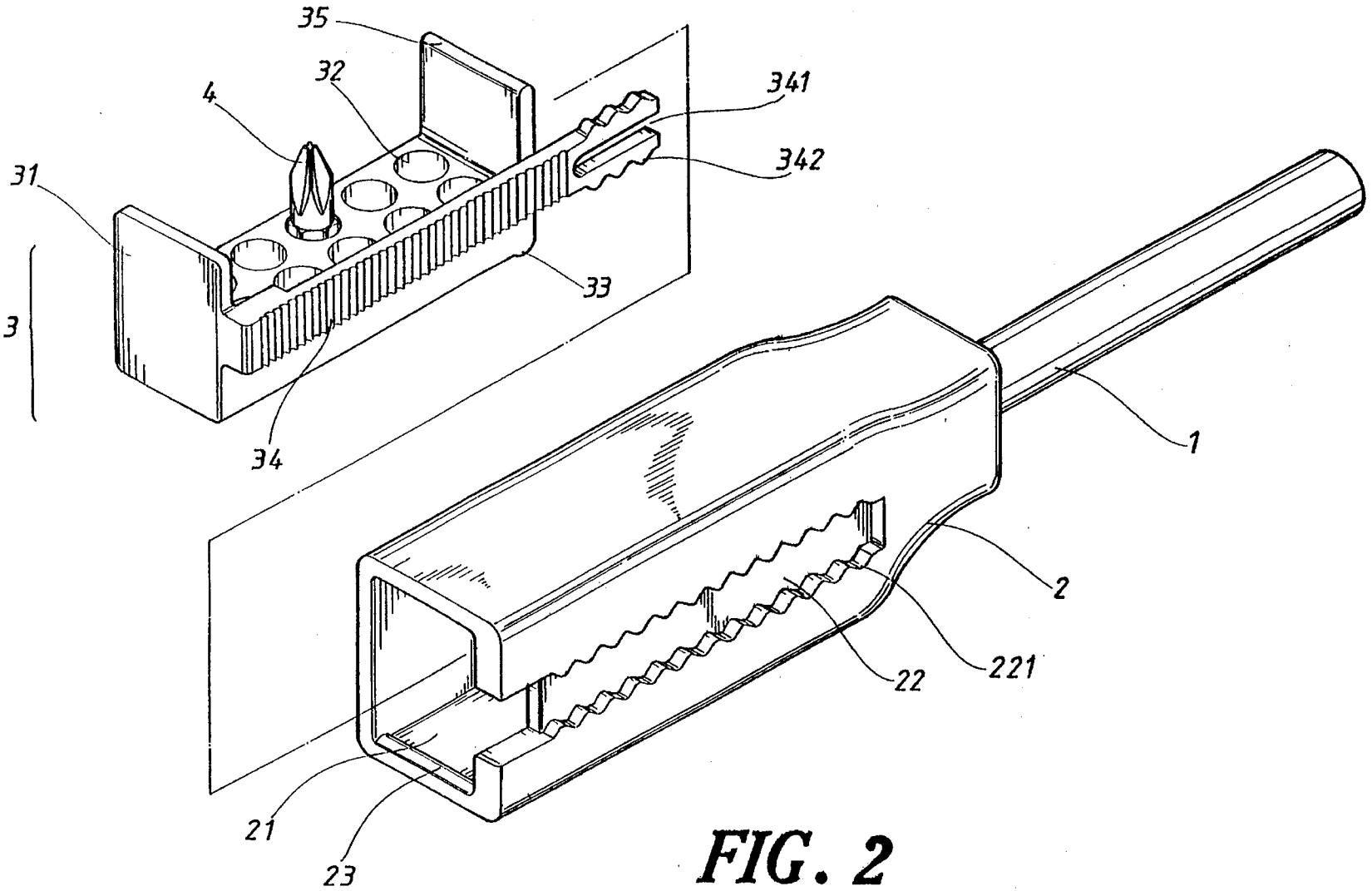
FIG. 2 is a perspective exploded view of the first embodiment of the present invention.

As shown in FIG. 2, the pushing lever 34 extends forward from a rear wall 31 of the cartridge 3. The length of the pushing lever 34 is larger than that of the cartridge 3, whereby when the cartridge 3 is mostly slid outside the rear receptacle 21 of the casing 2, the dented section 342 of the front end of the pushing lever 34 is still engaged with the dented upper and lower edges 221 of the casing 2. A slit 341 is lengthwise formed at the front end of the pushing lever 34, whereby when the dented section 342 thereof is slid along the guiding channel 22, the dented section 342 is slightly contracted by the dented edges 221 so as to smoothen the travel of the pushing lever 34. A clearance is defined between the pushing lever 34 and the dented edges 221 so that the pushing lever 34 is clamped between the dented edges 221 to associate the cartridge 3 with the casing 2 without sliding or swinging due to the use of the screwdriver. The cartridge 3 is formed with multiple vertical chambers 32 for receiving different reserved tool heads 4. A front wall 35 of the cartridge 3 is formed with a bottom flange 33 and the inner side of the rear end of the receptacle 21 is formed with an upward projecting flange 23 corresponding to the bottom flange 33, whereby when the cartridge 3 is pushed outward from the casing 2 by a normal force, the bottom flange 33 is stopped by the flange 23 and prevented from slipping out of the receptacle 21 of the casing 2. However, when a greater pushing force is exerted on the cartridge 3, the same can be detached from the casing 2 and be replaced by another module of tool heads.

Figure 3:
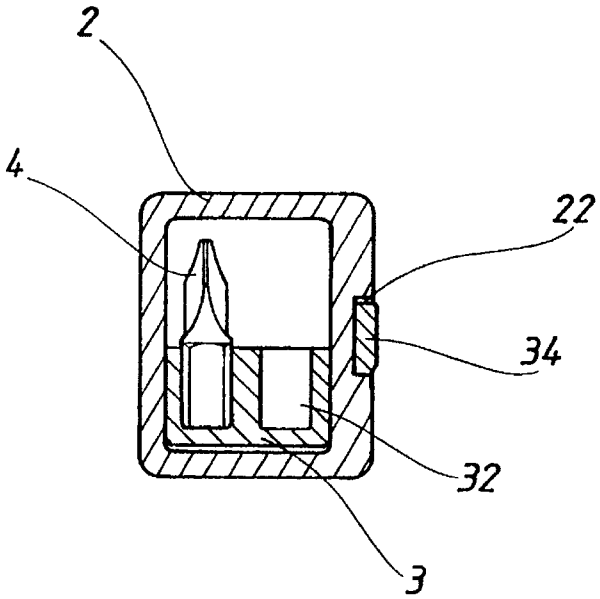
FIG. 3 is a sectional view taken along line A–A1 of FIG. 1.

Referring to FIG. 3 which is a sectional view taken along line A–A1 of FIG. 1, it can be seen that the pushing lever 34 of the cartridge 3 is received within the guiding channel 22 of the casing 2 and the cartridge 3 is formed with the chambers 32 for receiving the exchangeable tool heads 4.

Figure 4:
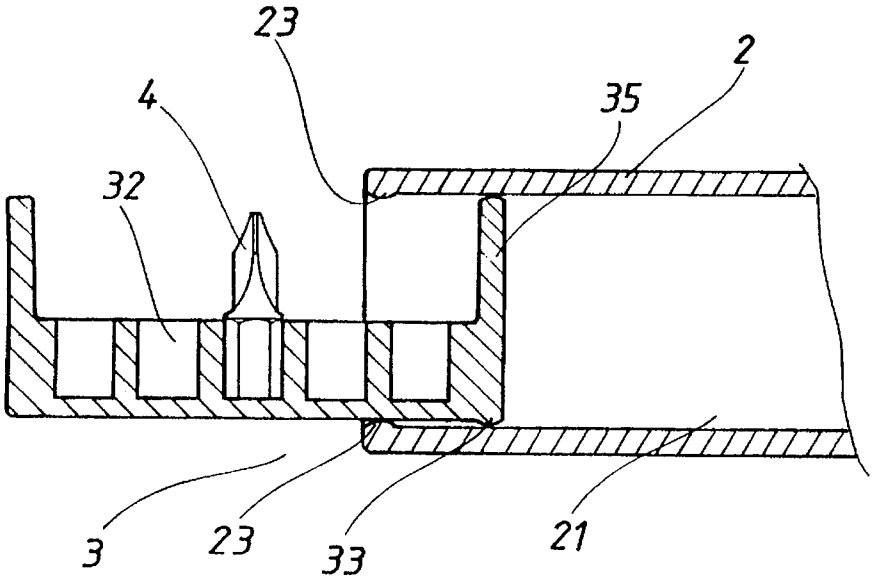
FIG. 4 is a sectional view taken along line B–B1 of FIG. 1.

Referring to FIG. 4 which is a sectional view taken along line B–B1 of FIG. 1, it can be seen that the cartridge 3 is slidably received in the rear receptacle 21 of the casing 2. The bottom flange 33 of the cartridge 3 is adapted to abut against the upward projecting flange 23 of the casing 2 so as to prevent the cartridge 3 from dropping outside the casing 2. However, when it is desired to replace the cartridge 3 with a new one, a pushing force can be exerted onto the cartridge 3 in a proper direction to push the cartridge 3 out of the casing 2.

Figure 5:
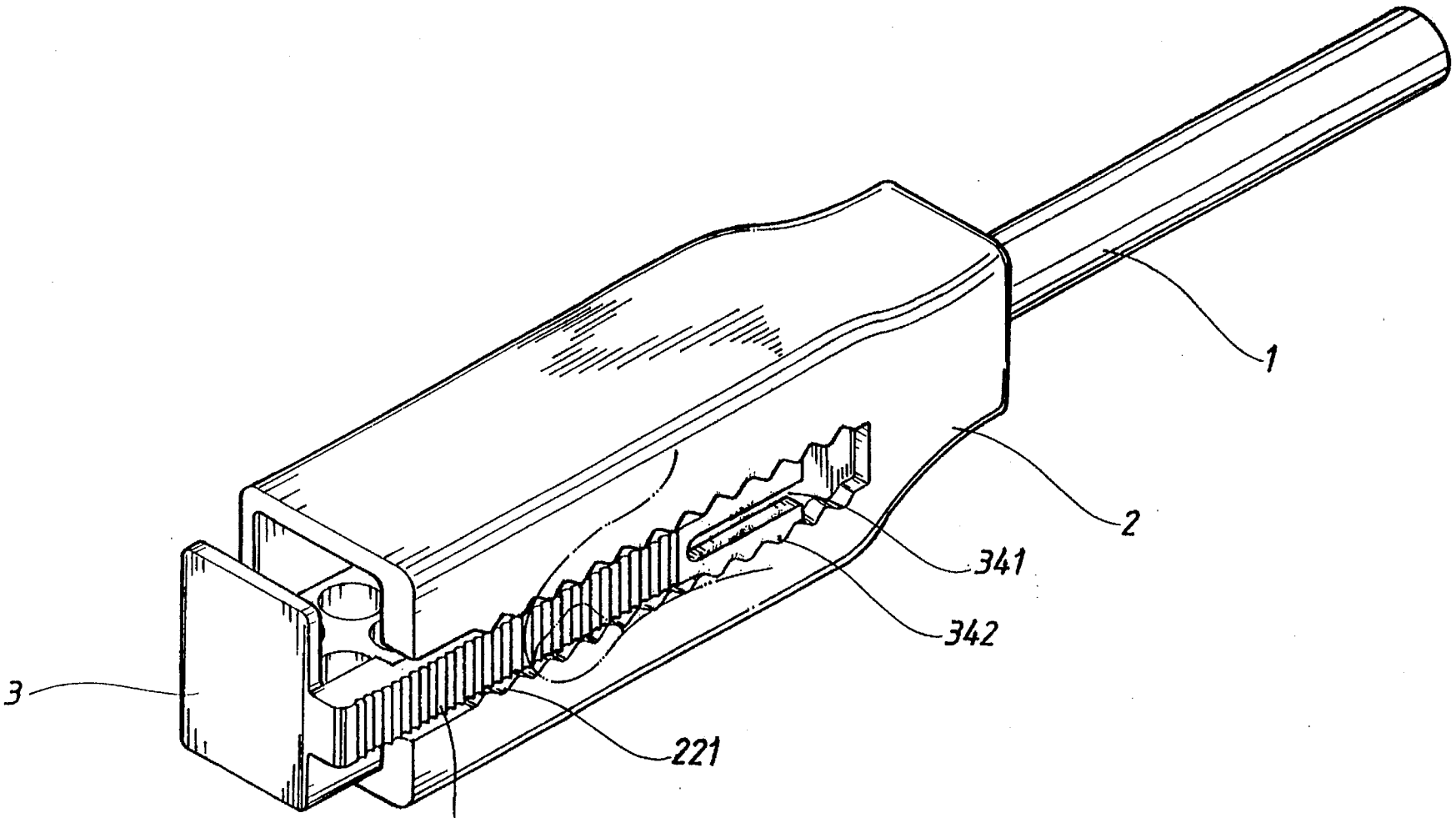
FIG. 5 shows that the cartridge is pushed outward from the casing with the pushing lever of the cartridge slided along the guiding channel of the casing.

Please refer to FIG. 5, wherein when the user pushes the pushing lever 34 outward with a finger, the slit 341 of the pushing lever 34 is narrowed and the dented section 342 is disengaged from the dented edges 221. Accordingly, the cartridge 3 can be easily slid outward along the guiding channel 22 with one finger. When the pushing lever 34 is released from the pushing force, the dented section 342 further engages with the dented edges 221 at a desired position. At this time, the user can select and take out a needed tool head for replacing the used one.

Figure 6:
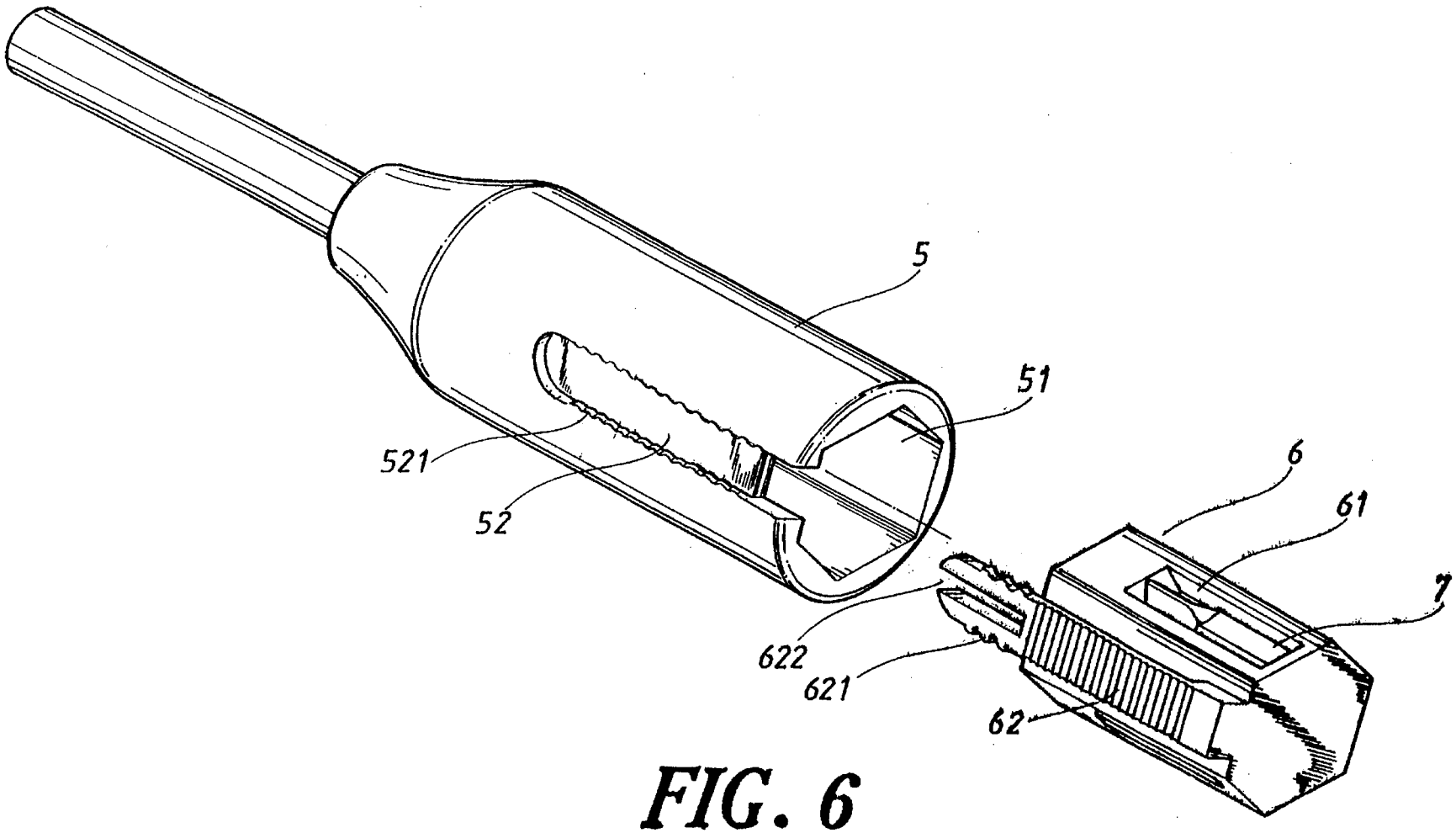
FIG. 6 is a perspective exploded view of a second embodiment of the present invention.

FIG. 6 shows a second embodiment of the present invention, wherein the screwdriver includes a cylindrical casing 5 having a rear hexagonal receptacle 51 and a hexagonal cartridge 6 received therein. Multiple lengthwise chambers 61 are formed on the periphery of the cartridge 6 parallel to a lengthwise pushing lever 62 thereof for receiving various reserved tool heads 7. The casing 5 is disposed with a guiding channel 52 on a lateral side. The upper and lower edges 521 of the guiding channel 52 are dented corresponding to a front dented section 621 of the pushing lever 62 so as to engage therewith. The length of the pushing lever 62 is larger than that of the cartridge 6, whereby when the cartridge 6 is mostly slid outside the rear receptacle 51 of the casing 5, the dented section 621 of the front end of the pushing lever 62 is still engaged with the dented upper and lower edges 521 of the casing 5. A slit 622 is lengthwise formed at the front end of the pushing lever 62, whereby when the dented section 621 thereof is slid along the guiding channel 52, the dented section 621 is slightly contracted by the dented edges 521 so as to smoothen the travel of the pushing lever 62. A clearance is such defined between the pushing lever 62 and the dented edges 521 that the pushing lever 62 is clamped between the dented edges 521 to associate the cartridge 6 with the casing 5 without sliding or swinging due to the use of the screwdriver. The surface of the pushing lever 62 is waved to facilitate the pushing of the cartridge 6.

Figure 7:
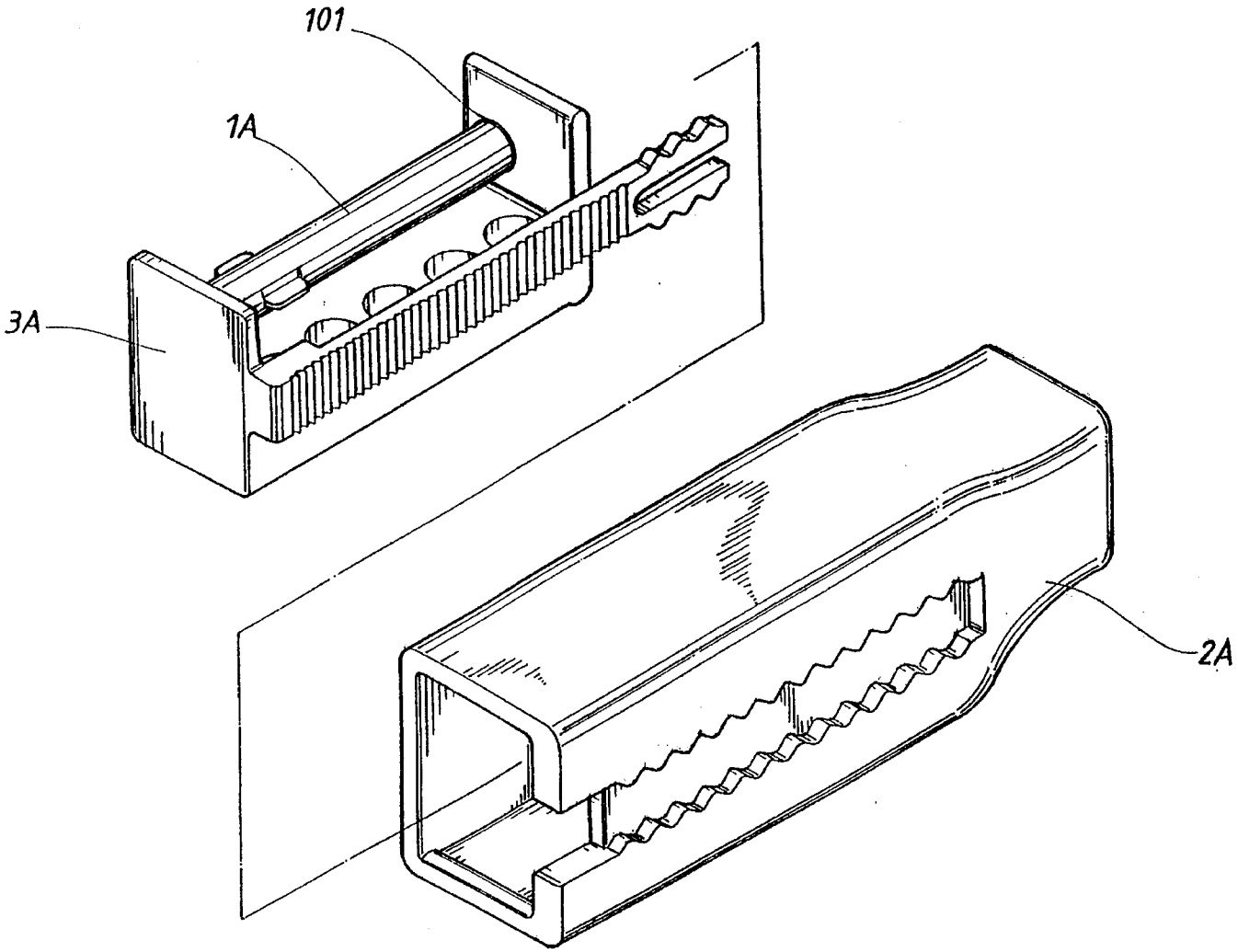
FIG. 7 is a perspective exploded view of a third embodiment of the present invention.

FIG. 7 shows a third embodiment of the present invention, wherein a support rod 1A is detachably disposed at the front end of the casing 2A. When not used, the support rod 1A is detached from the casing 2A and placed into a support rod seat 101 inside the cartridge 3A so as to reduce the occupied space and facilitate the storage of the screwdriver.

In conclusion, the screwdriver with slidably stored tool head module according to the present invention enables a user in working state to easily quickly push the stored tool head module outward with only one finger and select a suitable tool head therefrom for replacing a used one. Therefore, the tool head replacing procedure is time-saving and labor-saving.

It is to be understood that the above description and drawings are only used for illustrating some embodiments of the present invention, not intended to limit the scope thereof. Any variation and derivation from the above description and drawings should be included in the scope of the present invention.

What is claimed is:

1. A screwdriver with a stored tool head module comprising:

a) a casing including a front end for engaging a support rod to which a tool head may be interchangeably fitted, a rear receptacle, a lateral side, and a longitudinal guiding channel formed in the lateral side;

b) a cartridge slideably receivable within the rear receptacle of the casing, the cartridge including a plurality of chamber formed therein for containing a module of multiple tool heads;

c) a pushing lever longitudinally received and guided by the guiding channel for slideably moving the cartridge outwardly of the rear receptacle and permitting the selective removal or replacement of a tool head; and d) the pushing lever having a length greater than the length of the cartridge and a front end formed with a dented section and a slit formed at a central portion of the front end; and the guiding channel having a dented upper edge and a dented lower edge corresponding to and engageable with the dented section.

2. The screwdriver of claim 1 wherein the pushing lever includes an outer surface having a waved configuration for facilitating pushing of the cartridge.

3. The screwdriver of claim 1 wherein the casing is of a cylindrical configuration.

4. The screwdriver of claim 1 wherein the casing is of a polygonal configuration.

5. A screwdriver with a stored tool head module comprising:

a) a casing including a front end for engaging a support rod to which a tool head may be interchangeably fitted, a rear receptacle, a lateral side, and a longitudinal guiding channel formed in the lateral side;

b) a cartridge slideably receivable within the rear receptacle of the casing, the cartridge including a plurality of chambers formed therein for containing a module of multiple tool heads;

c) a pushing lever longitudinally received and guided by the guiding channel for slideably moving the cartridge outwardly of the rear receptacle and permitting the selective removal or replacement of a tool head and;

d) the cartridge includes a front wall provided with a bottom flange, the receptacle includes a rear end having an inner side provided with an upwardly projecting flange corresponding to the bottom flange, whereby when the cartridge is pushed outwardly from the rear receptacle, the bottom flange engages the upwardly projecting flange to prevent the cartridge from slipping out of the rear receptacle upon the application of a first force to the pushing lever.

6. The screwdriver of claim 5 wherein when a second force greater than the first force is applied to the pushing lever, the bottom flange detaches from the upwardly projecting flange to permit removal of the cartridge from the rear receptacle.

7. A screwdriver with a stored tool head module comprising:

a) a casing including a front end for engaging a support rod to which a tool head may be interchangeable fitted, a rear receptacle, a lateral side, and a longitudinal guiding channel formed in the lateral side;

b) a cartridge slideably receivable within the rear receptacle of the casing, the cartridge including a plurality of chambers formed therein for containing a module of multiple tool heads;

c) a pushing lever longitudinally received and guided by the guiding channel for slideably moving the cartridge outwardly of the rear receptacle and permitting the selective removal or replacement of a tool head and;

d) a support rod detachably engageable with the front end of the casing and the cartridge includes a seat for receiving the detached support rod.

* * * * *